US009089232B1

(12) United States Patent
Parazynski

(10) Patent No.: US 9,089,232 B1
(45) Date of Patent: Jul. 28, 2015

(54) TEA BREWING CONTAINMENT DEVICE AND METHOD OF USING SAME

(71) Applicant: Scott Edward Parazynski, Houston, TX (US)

(72) Inventor: Scott Edward Parazynski, Houston, TX (US)

( * ) Notice: Subject to any disclaimer, the term of this patent is extended or adjusted under 35 U.S.C. 154(b) by 0 days.

(21) Appl. No.: 14/503,716

(22) Filed: Oct. 1, 2014

(51) Int. Cl.
*A47G 19/16* (2006.01)
*A23F 3/18* (2006.01)

(52) U.S. Cl.
CPC .. *A47G 19/16* (2013.01); *A23F 3/18* (2013.01)

(58) Field of Classification Search
CPC .... A47G 21/106; A47J 31/20; A47J 31/4407; A23F 3/18
See application file for complete search history.

(56) References Cited

U.S. PATENT DOCUMENTS

| | | | | |
|---|---|---|---|---|
| 2,708,401 | A | 5/1955 | Leclerc et al. | |
| 2,887,948 | A | 5/1959 | Kramer et al. | |
| 3,342,518 | A | 9/1967 | Gorton, Jr. | |
| 5,335,591 | A | 8/1994 | Pozar | |
| 5,791,237 | A * | 8/1998 | Gibson | 99/510 |
| 6,966,256 | B2 * | 11/2005 | Canizares et al. | 100/126 |
| 2003/0106440 | A1 * | 6/2003 | Nelson | 100/110 |
| 2010/0139508 | A1 * | 6/2010 | Hansel et al. | 100/234 |

* cited by examiner

*Primary Examiner* — Anthony Weier
(74) *Attorney, Agent, or Firm* — Steven H. Greenfield; Greenfield Invention and Patent Consulting, Inc.

(57) ABSTRACT

Embodiments for a device and methods to contain a tea bag or tea leaves in the course of the preparation of a cup of tea are disclosed. The device holds in place the tea bag or tea leaves while immersed in hot water, provides for pressure onto the tea bag or tea leaves and provides for a plate or bowl to contain any dripping due to the removal of the bag or tea leaves from the cup.

20 Claims, 21 Drawing Sheets

FIG. 14
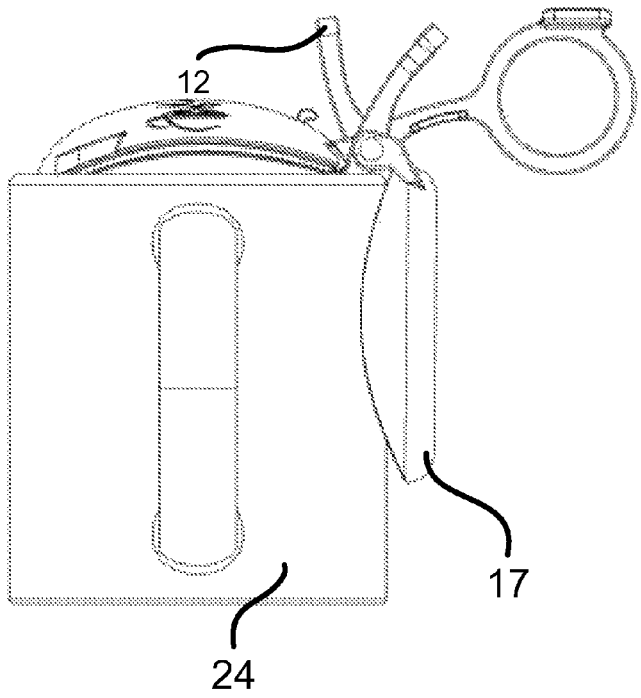
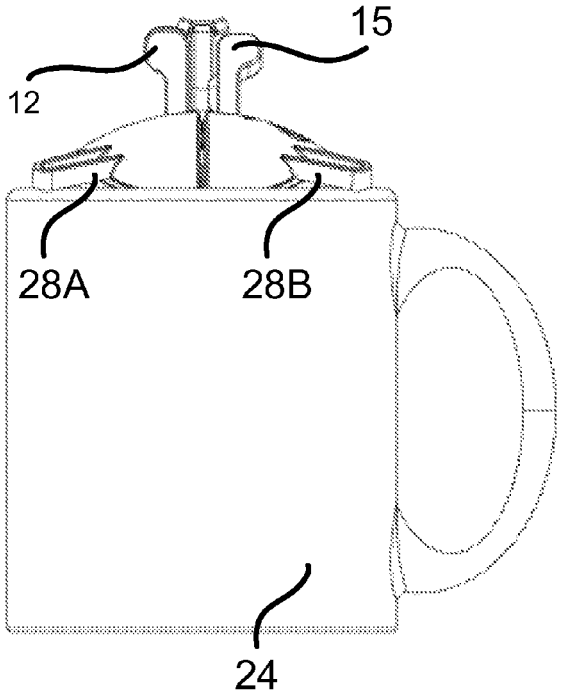
FIG. 15

FIG. 16
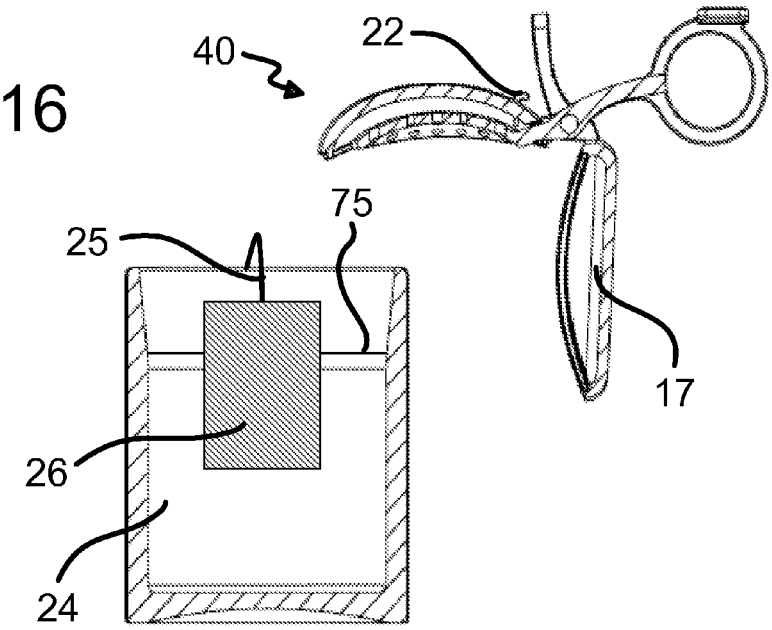
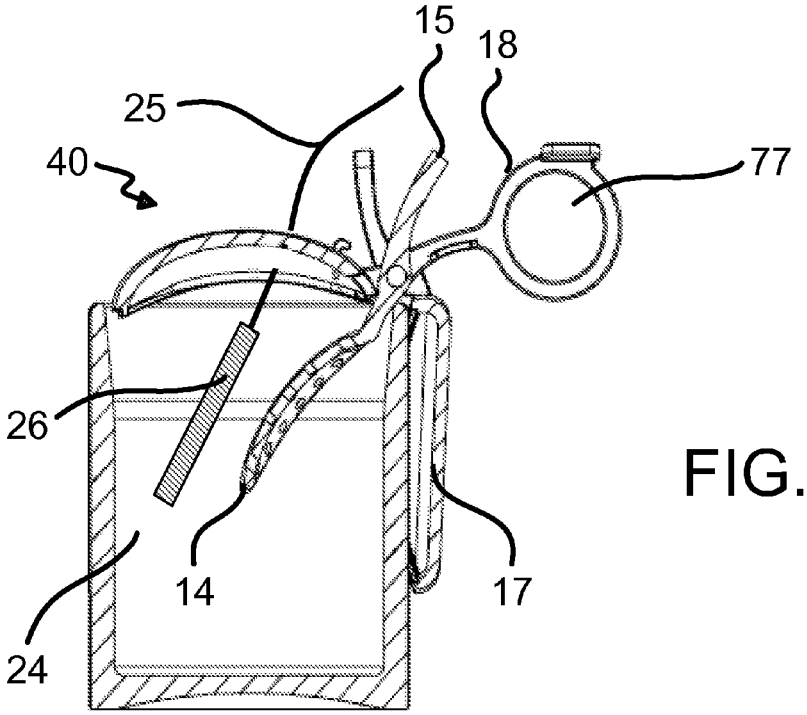
FIG. 17

87
80
37
48B
34
48A
87
34
80
71

TEA BREWING CONTAINMENT DEVICE AND METHOD OF USING SAME

RELATED APPLICATIONS

This application claims priority from provisional application No. 61/887,350 filed on Oct. 5, 2013.

FIELD OF THE INVENTION

The present invention relates to a device for aiding in making a cup of tea, handling spent tea bags and tea leaves that result from preparing the cup of tea, and containing drippings that emanate from the spent tea bags or tea leaves after the cup of tea is made.

BACKGROUND OF THE INVENTION

A cup of tea is typically made by dipping a porous tea bag into a hot cup of water for several seconds to several minutes in order to release the tea flavor from the tea bag or tea strainer into the hot water. The tea bag is then removed. Removing the tea bag can be a messy process as the tea bag tends to drip and inadvertently sink to the bottom of the cup. Moreover, drippings can scald the skin, stain the tablecloth and/or create a pool of tea in a saucer, which might then drip on and stain one's clothing or tablecloth. Other disadvantages with the common method of preparing a cup of tea include the length of time needed to achieve an optimal flavor and the singular and thus potentially wasteful use of tea bags. Similar issues arise when the cup of tea is prepared from tea leaves. To prevent the undesirable mess resulting from disposing of the used tea leaves, multiple dishes need to be typically used in a time consuming process. Moreover, the damp tea bag or tea strainer, once removed from the cup, is unattractive and detracts from the tea brewing experience.

The present invention addresses all these negatives. The device used for preparing the cup of tea from a tea bag is a single unit assembly that provides for functionalities and features to 1) prevent the tea bag or from sinking to the bottom so that its retrieval would not require reaching into the cup with ones' fingers or a spoon, 2) prevent dripping outside the cup when the bag is removed, 3) shorten the time to squeeze out the flavor from the tea bag into the water and obviate the need for wrapping the tea bag around a spoon or other secondary utensil to squeeze the tea bag before removing from the cup of tea, 4) enable reusing a tea bag at least once, and 5) obscure from view the unattractive, damp, used tea bag following brewing.

The device for preparing the cup of tea from tea leaves is a single unit assembly that provides for functionalities and features to 1) prevent the tea leaves from sinking to the bottom of the cup so that its retrieval would not require reaching into the cup with a spoon, 2) prevent dripping outside the cup when the bag is removed, and 3) shorten the time to squeeze out the flavor from the tea leaves into the water and obviate the need for handling the tea leaves multiple times. 4) potentially reuse the tea leaves at least once and 5) obscure from view the unattractive, damp, used tea leaves following brewing.

A number of prior art references that relate to tea bag holding and squeezing devices. In U.S. Pat. No. 5,335,591 two porous plates are attached to the ends of the tong. U.S. Pat. No. 2,887,948 likewise discloses two dome shaped porous plates connected to a common hinge. References that indicate at least one porous plate include U.S. Pat. No. 3,342,518 and U.S. Pat. No. 2,708,401.

SUMMARY OF THE PRESENT INVENTION

In one aspect of the present invention, a tea bag containment assembly for manipulating a hot tea bag in the course of preparing a cup of tea, the device comprises: an upper plate member containing a split plate having a center slit, a pivot axis and a handle; an open plate member containing a porous plate having plurality of holes, a pivot axis and a handle; and a catch basin member containing a closed catch plate having a rim around an upper part of the catch plate, the catch basin member also comprising a pivot axis and a handle, the split plate being configured for placement on top of the porous plate, the porous plate being configured for placement over the catch plate, the porous plate configured for allowing liquid to drain through, the split plate, porous plate and catch plate being configured for pivotal attachment to one another, the attachment being accomplished through the pivot axis of the upper plate member, the pivot axis of the open plate member and the pivot axis of the catch basin member.

In another aspect of the present invention, a method for preparing a cup of tea from a tea bag having a string attached to the tea bag in a standard cup, the cup having inner and outer walls, the method comprises: providing a tea bag containment assembly comprising an upper plate member containing a split plate having a center slit, a pivot axis and a handle; an open plate member containing a porous plate having plurality of holes, a pivot axis and a handle; and a catch basin member containing a closed catch plate having a rim around an upper part of the catch plate, the catch basin member also comprising a pivot axis and a handle, the split plate containing an anvil, the anvil being disposed at a rear side of the center slit, the porous plate and catch plate being pivotally attached to the split plate, the split plate also containing at least one lip extending out of a front side of the split plate, the porous plate being configured to exert pressure onto a bottom of the split plate; providing a cup having a wall and a top rim, the cup containing hot water; placing an unused tea bag inside the cup, the tea bag string being disposed outside the cup in a manner as to enable preparing a cup of tea; placing the tea bag containment assembly onto the cup wherein the split plate is disposed onto the rim of the cup, the catch plate is disposed outside the cup alongside an outer side of the cup wall and the porous plate being disposed inside the cup below the tea bag; pivoting the porous plate upward in a manner as to trap and squeeze the tea bag against the split plate; moving the tea bag containment assembly upward in such a manner that the catch plate clears the cup, and drippings from the tea bag that go through the porous plate fall into the cup; pivoting the catch plate upward toward the porous plate in a manner as to contain any further drippings from the tea bag; and enjoying a delicious cup of tea.

In yet another aspect of the present invention, a tea leaf containment assembly for manipulating loose tea leaves in the course of preparing a cup of tea, the device comprises: an upper bowl member containing an upper bowl, the upper bowl being downwardly concave, the upper bowl member also containing a pivot axis; a strainer member containing a downwardly concave strainer bowl having a plurality of holes, the strainer member also containing a pivot axis and a handle; and a catch basin member containing a downwardly concave lower bowl, the catch basin member also containing a pivot axis and a handle, the upper bowl being configured for placement on top of the strainer bowl, the strainer bowl being configured for placement over the lower bowl, the strainer bowl being configured for allowing liquid to drain through, the upper bowl, strainer bowl and lower bowl being configured for pivotal attachment to one another, the attachment being accomplished through the pivot axis of the upper bowl member, the pivot axis of the strainer member and the pivot axis of the catch basin member.

In yet a further aspect of the present invention, a method for preparing a cup of tea from tea leaves in a standard cup having inner and outer walls, the method comprises: providing a tea leaf containment assembly, the tea leaf containment assembly comprising an upper bowl member containing an upper bowl, the upper bowl being downwardly concave, the upper bowl member also containing a pivot axis; a strainer member containing a downwardly concave strainer bowl having a plurality of holes, the strainer member also containing a pivot axis and a handle; and a catch basin member containing a downwardly concave lower bowl, the catch basin member also containing a pivot axis and a handle, the strainer bowl and lower bowl being pivotally attached to the upper bowl, the strainer bowl also containing at least one lip extending out of a front side of the strainer bowl, the upper bowl being configured to exert pressure onto the strainer bowl; providing a cup having a wall and a top rim, the cup containing hot water; placing a tea leaf containment assembly onto the cup wherein the strainer bowl is placed over the cup rim in such a manner that the extending lips rest against the rim, the upper bowl is elevated above the strainer bowl and the lower bowl is pivoted downward and disposed outside the cup alongside an outer side of the cup wall, wherein a lower portion of the strainer bowl is immersed in the water; placing tea leaves inside the strainer bowl; pivoting the upper bowl downward onto the strainer bowl in a manner as to trap and squeeze the tea leaves against the strainer; moving the tea containment assembly upward in such a manner that the lower bowl clears the cup and in a manner that tea drippings from the tea leaves that pass through the strainer bowl fall into the cup; pivoting the lower bowl upward toward the strainer bowl to align horizontally with the strainer bowl in a manner as to contain any further drippings from the tea leaves; and enjoying a delicious cup of tea.

These and other features, aspects and advantages of the present invention will become better understood with reference to the following drawings, description and claims.

BRIEF DESCRIPTION OF THE DRAWINGS

FIGS. 13, 14, 15, 16, 17, 18, 19, and 20 portray the assembled tea bag containment device of the first embodiment of the present invention being used in the course of preparing a cup of tea;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

A first embodiment of the present invention relates to a device for containing, manipulating and handling a tea bag and is configured to control the flavor transferred to hot water in a quick an efficient manner while preventing potentially messy and scalding liquid drippings from contacting the skin or the outside of the tea cup as the bag is removed. Moreover, the device allows for reuse of tea, as desired, while also obscuring the view of unattractive and damp tea the form of a tea bag or brewed tea leaves.

Figure 1:
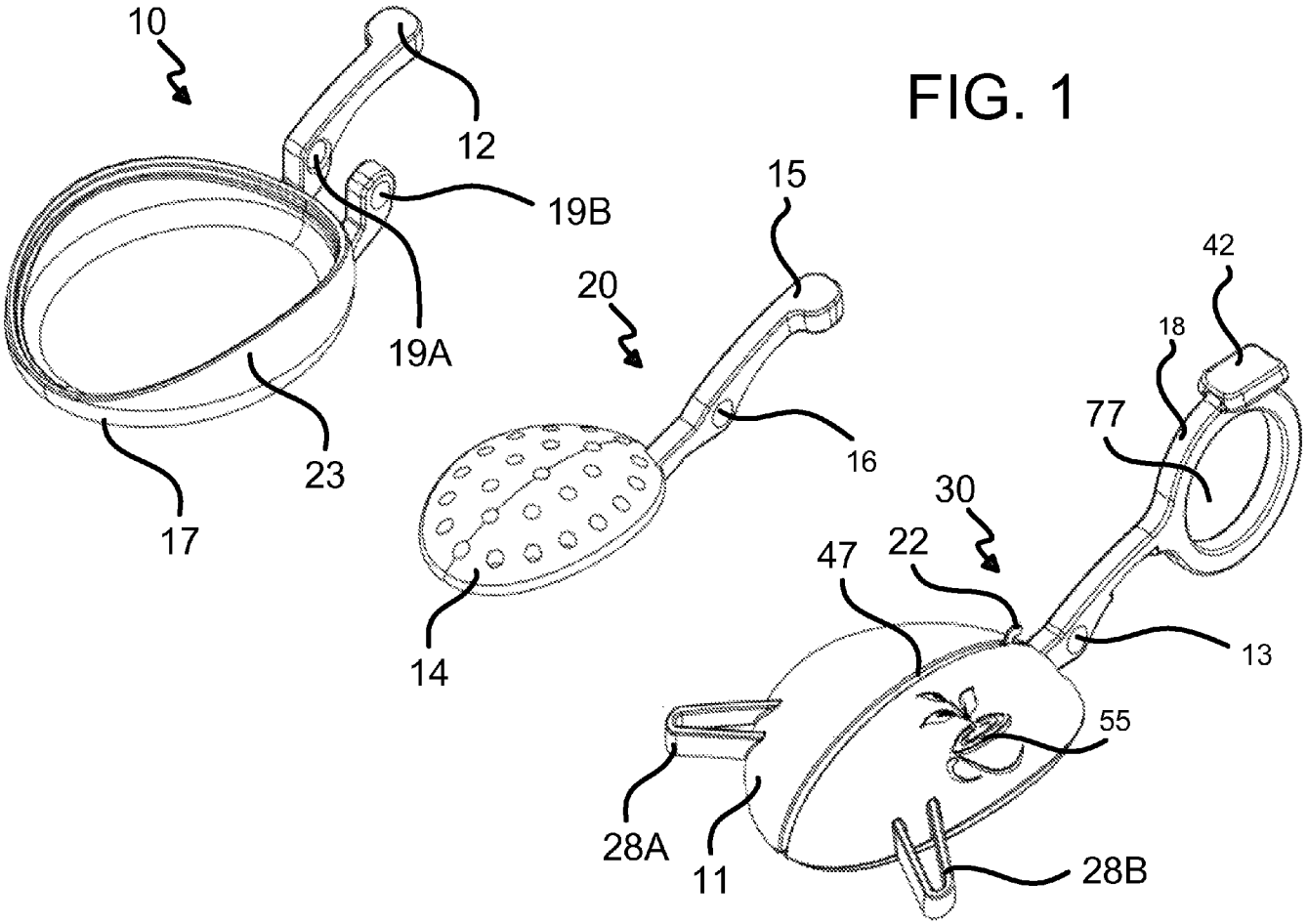
FIG. 1 is an exploded view of the main components of a tea bag containment device according to a first embodiment of the present invention.

Drawings 1-20 illustrate a containment device generally useful for making cups of tea from tea bags. FIG. 1 shows the main components of the device. An upper plate member 30 contains a split plate 11 having a pivot axis 13 and a handle 18. The handle 18 has a thumb rest 42 and a loop 77 for easy manipulating and handling. An open plate member 20 contains a porous plate 14 having a plurality of holes, a pivot axis 16 and tabbed handle 15. A catch basin member 10 contains a closed catch plate 17 having a rim 23 around an upper part of the catch plate 17. The catch basin member 10 also contains pivot axes 19A and 19B and tabbed handle 12. Additional features include: two lips 28A and 28B extending from the upper surface of the split plate 11, a slit 47 at about the center of the split plate 11 and an ornamental design 55 placed on the split plate. An anvil 22 is placed at the rear end of the slit 47. All the components are detachable from each other and reattachable through the use of hinge pin 85. This feature enables easy cleaning of the device.

Figure 3:
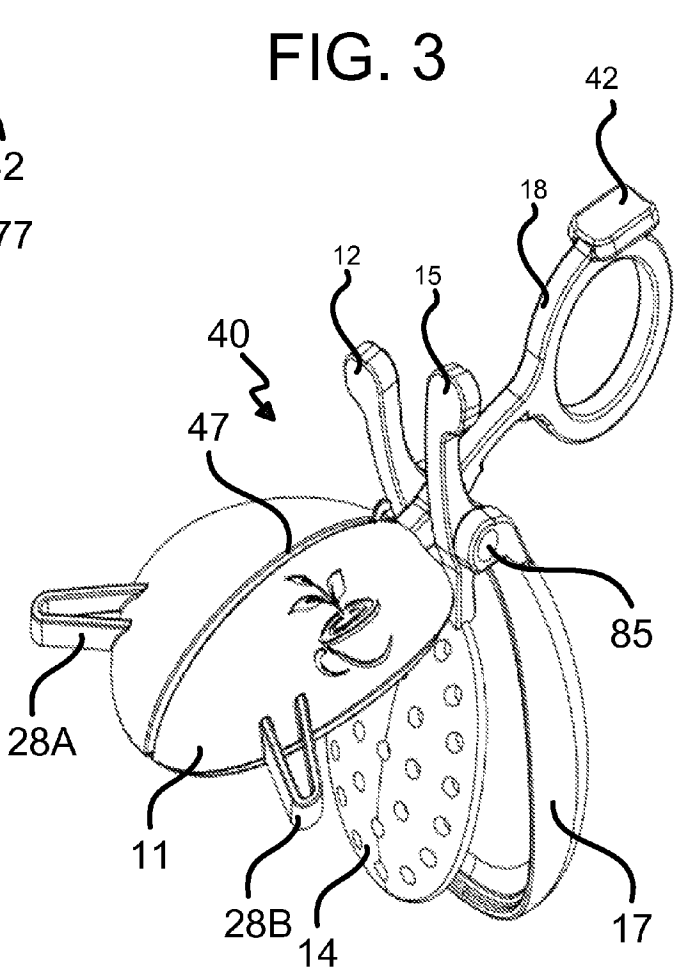
FIGS. 2, 3, 6 and 10 are perspective views of the assembled tea bag containment device shown in different configurations according to the first embodiment of the present invention.
Figure 2:
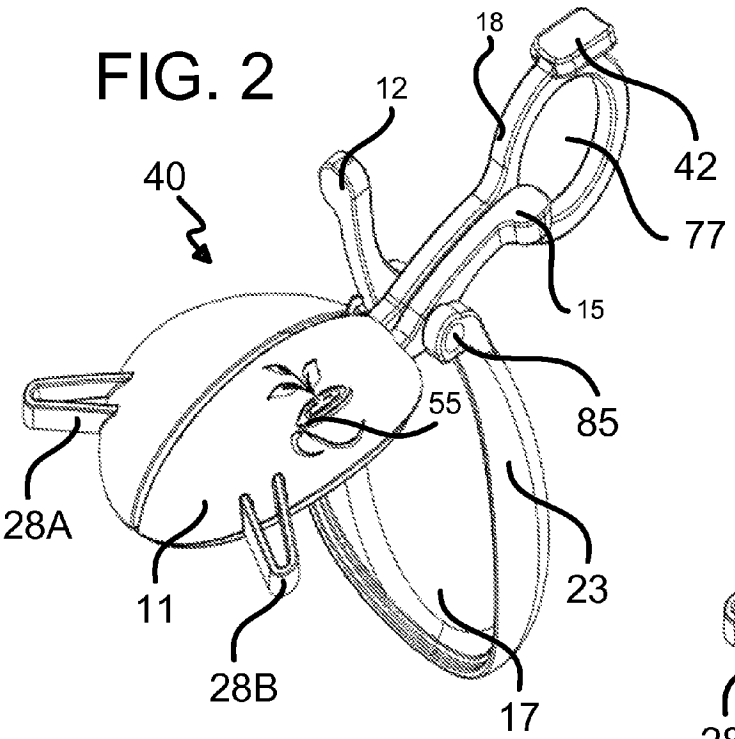
Figure 5:
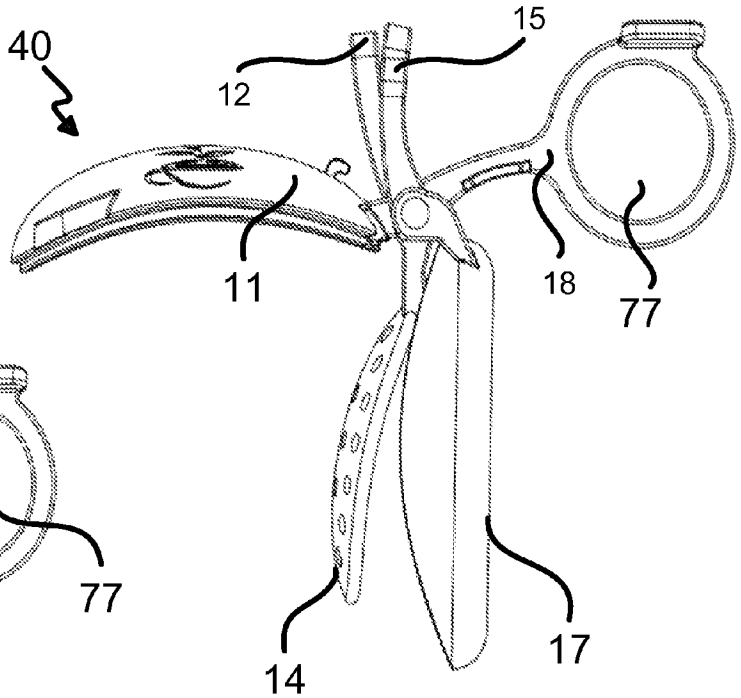
FIGS. 4 and 5 are side views of the assembled tea bag containment device in different configurations according to the first embodiment of the present invention.
Figure 4:
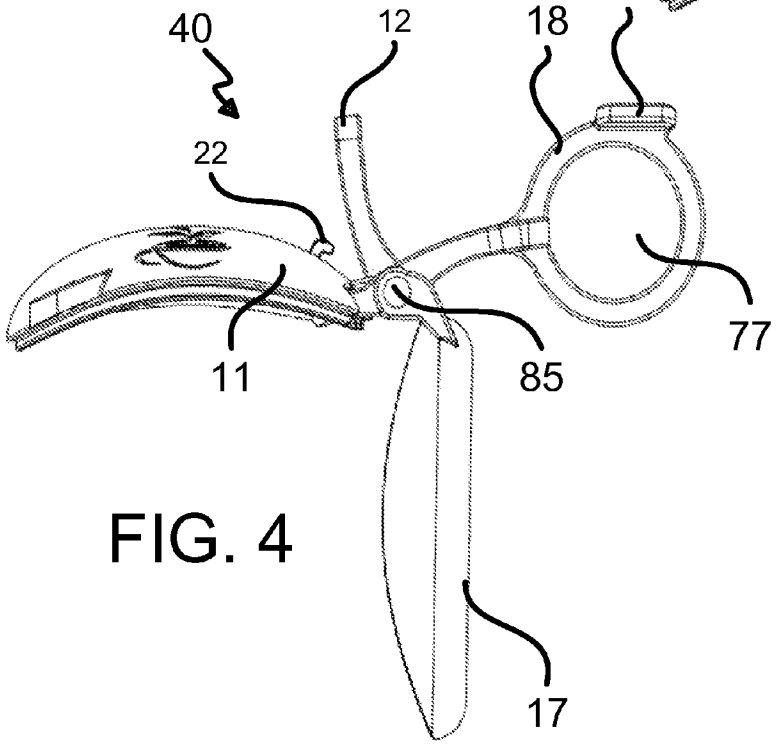
Figure 7:
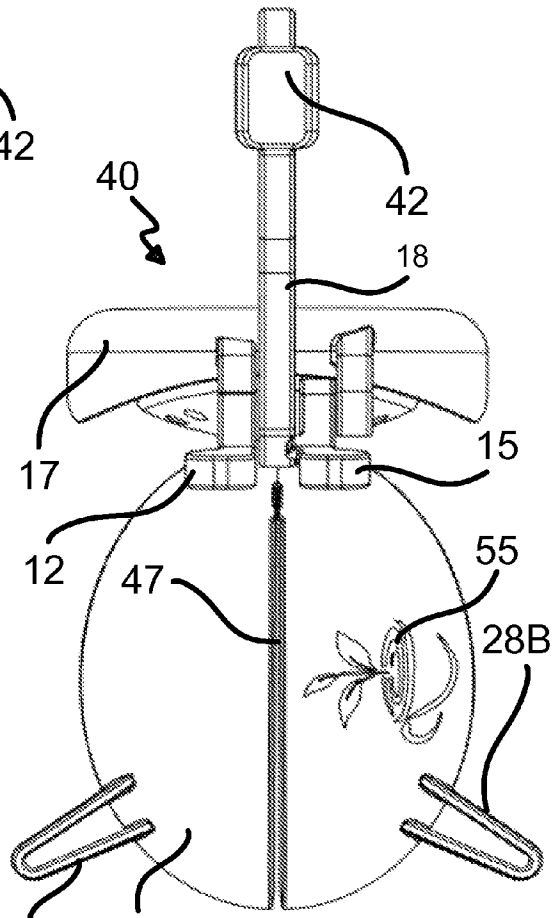
FIGS. 7, 8, 9 11 and 12 are top views of the assembled tea bag containment device in different configurations according to the first embodiment of the present invention.
Figure 6:
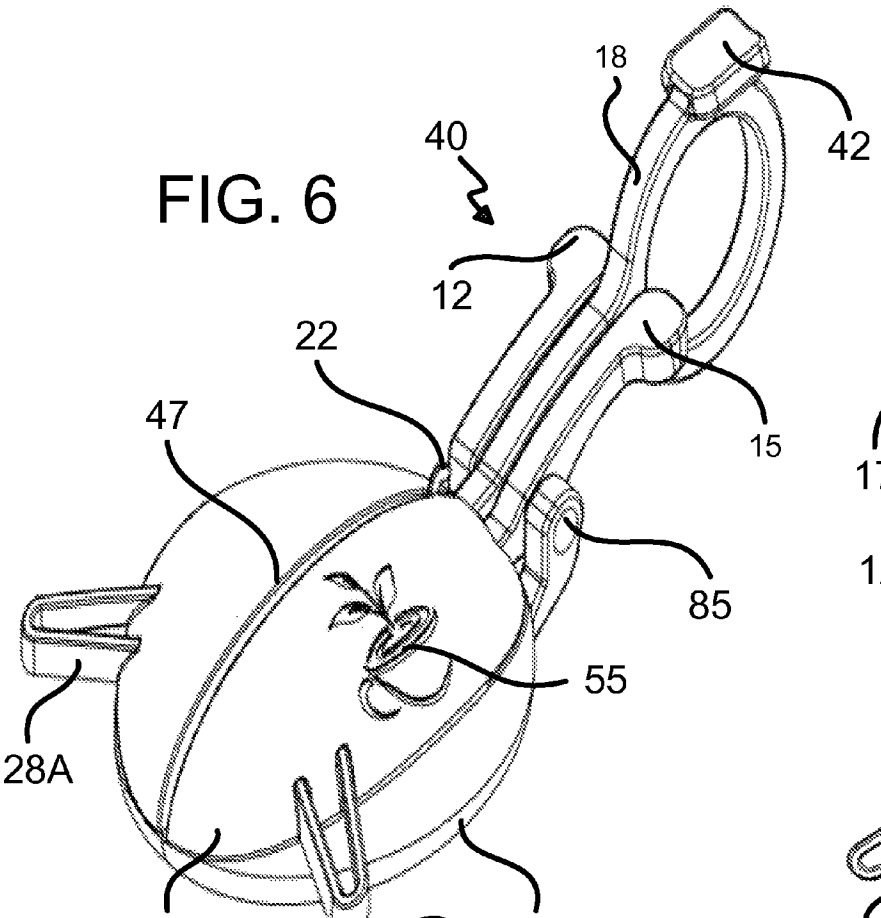
Figure 9:
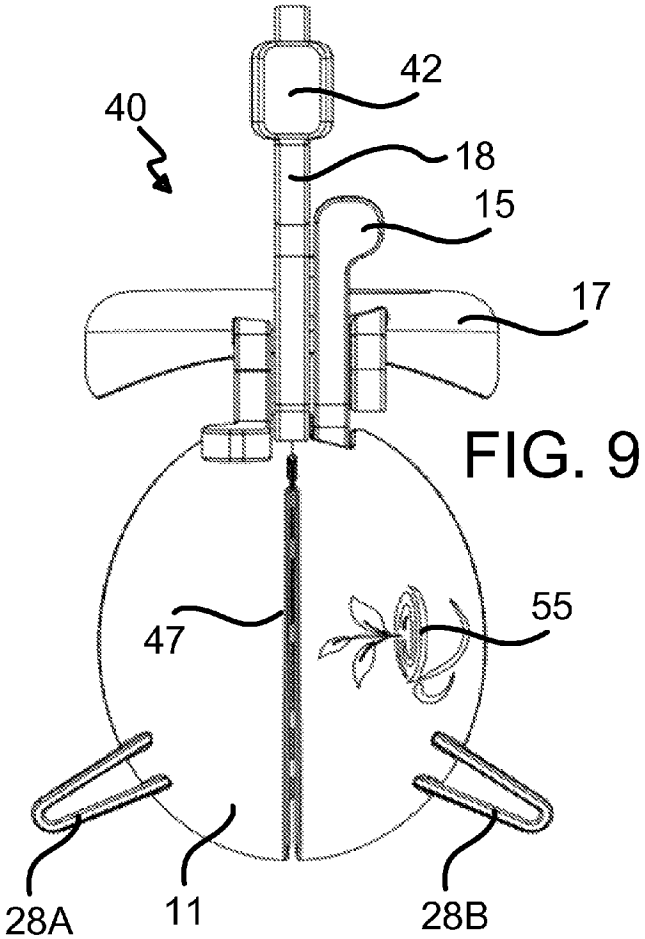
Figure 8:
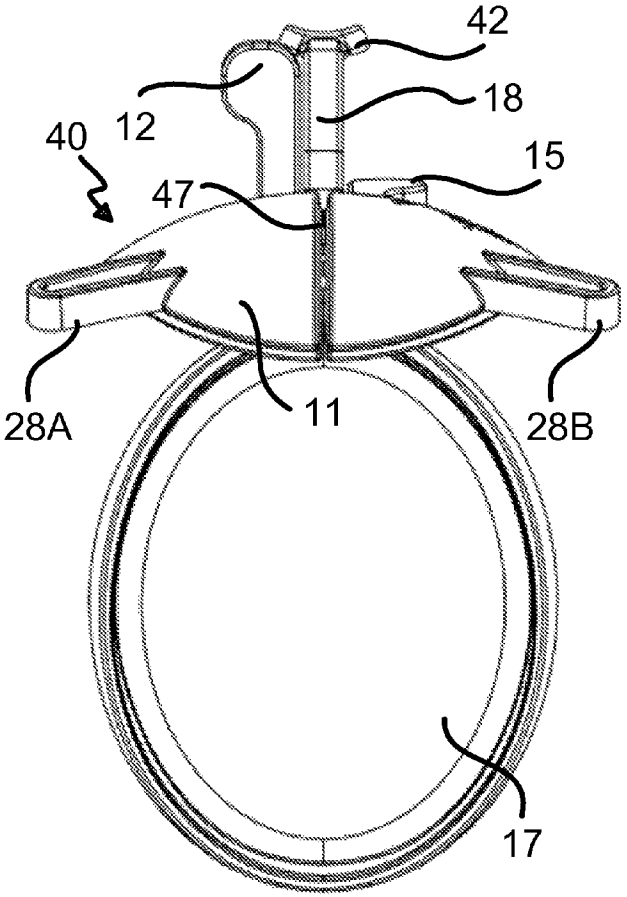
Figure 11:
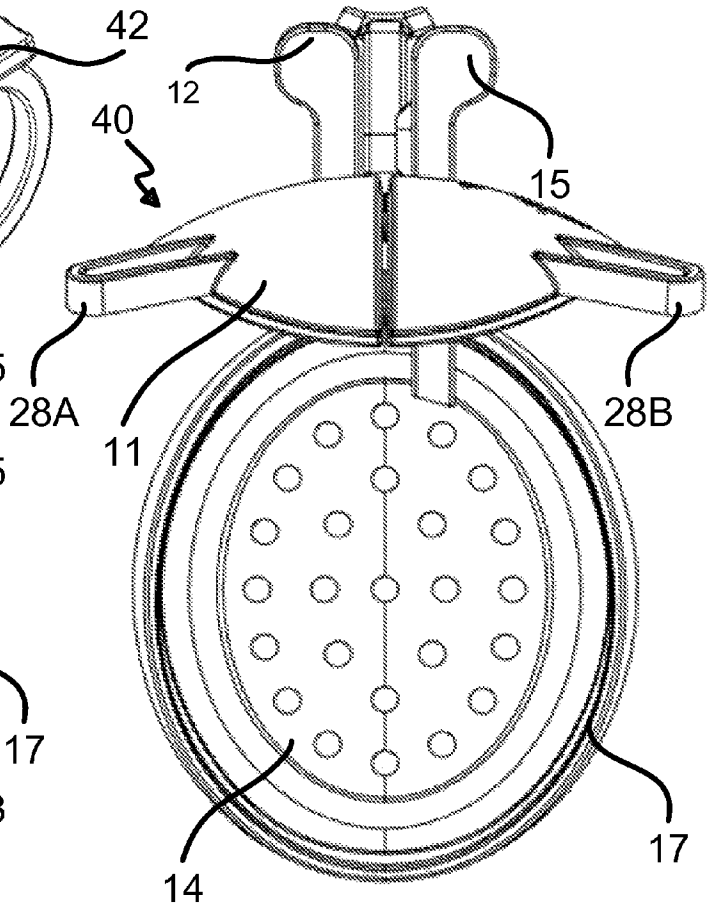
Figure 10:
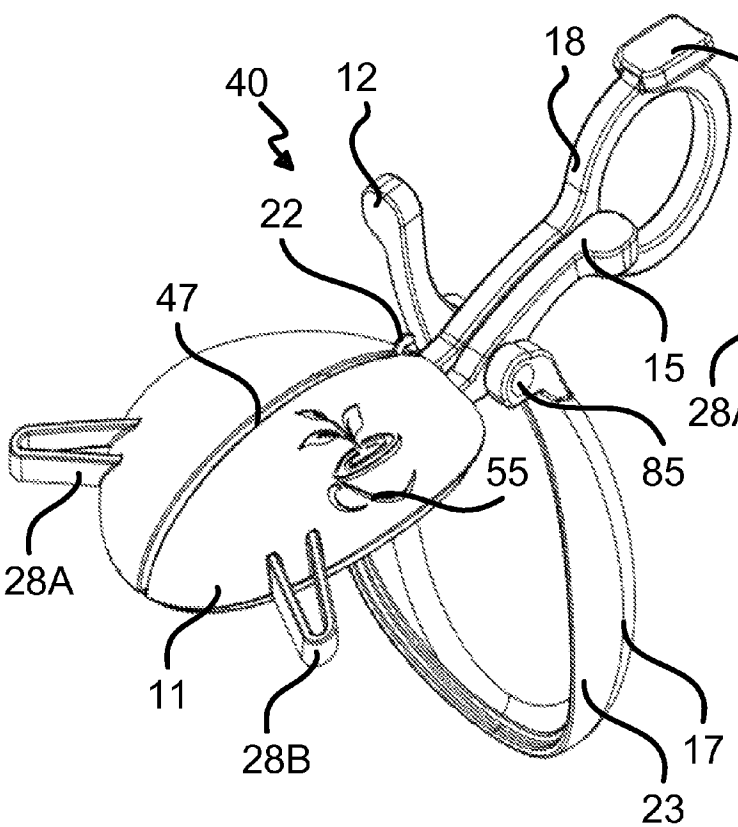

The assembled apparatus 40 is shown in FIGS. 2-11. Combining the upper plate member 10 with the open plate member 20 and the catch basin member 30 is accomplished through the pivot axes 13, 16, 19A and 19B and hinge pin 85. The combined device is configured to permit the pivoting of the split plate 11, the porous plate 14 and the catch plate 17 from a horizontal position downward to a vertical position and back to a horizontal position independently of each other. To actuate the pivoting of any of the components, the tea preparer would press onto or release handles 12, 15 and 18 as appropriate. Thus, in FIGS. 2 and 4 for example, the porous plate 14 and the split plate 11 are in a horizontal position, while the catch plate 17 is in a vertical position. In FIGS. 3 and 5, the porous plate 14 and the catch plate 17 are in a vertical position while the split plate 11 is in a horizontal position. In FIG. 6, the device is shown in a closed position wherein all three plates are combined and in a horizontal position. In the closed position, the components of the device, i.e., the upper plate member, the open plate member and the catch basin member are constructed to tightly fit over each other using shiplap joinery overlaps in a manner as to prevent leaking of fluid to the outside. A compliant snap may further be used to insure that the components are locked in place and for their easy disassembly and reassembly.

Figure 13:
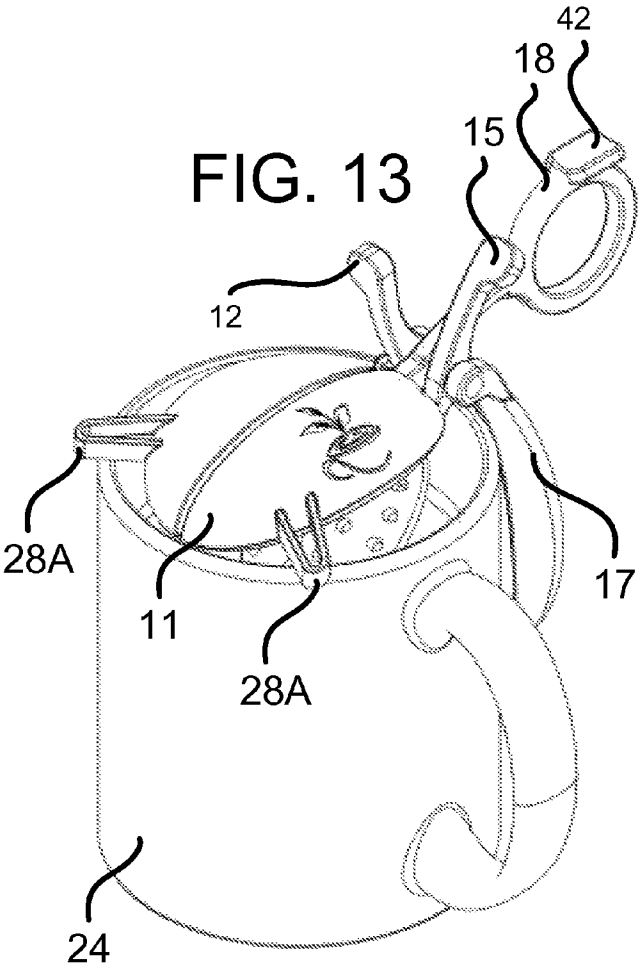
Figure 12:
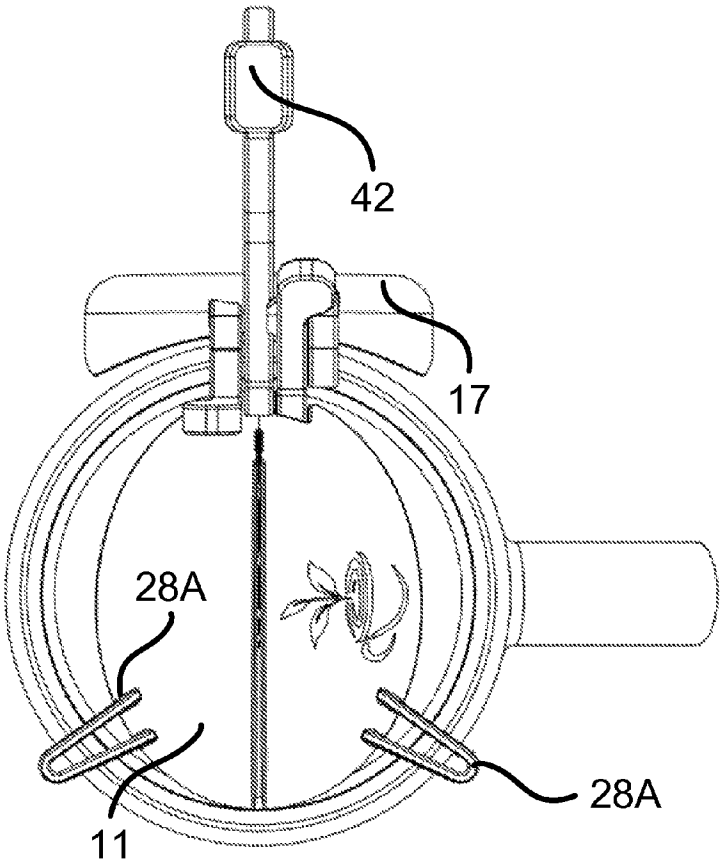

FIGS. 13-15 show the positioning of the tea bag containment assembly 40 in a cup 24. Lip extensions 28A and 28B that are attached to the split plate 11 rest on the rim of the cup 24 to prevent the split plate 11 from dropping into the cup. The porous plate 14 is free to pivot inside the cup 24, while the catch plate 17 is in a vertical stance outside the cup 24 resting against its outer wall.

Figure 18:
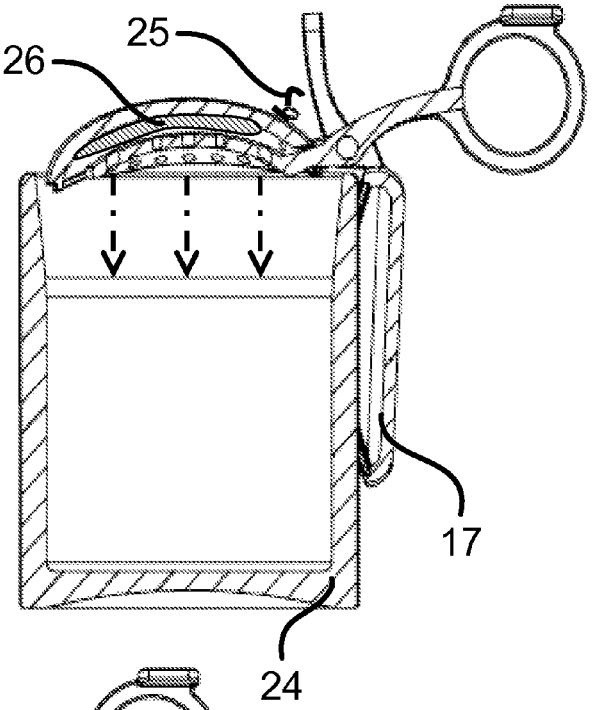
Figure 19:
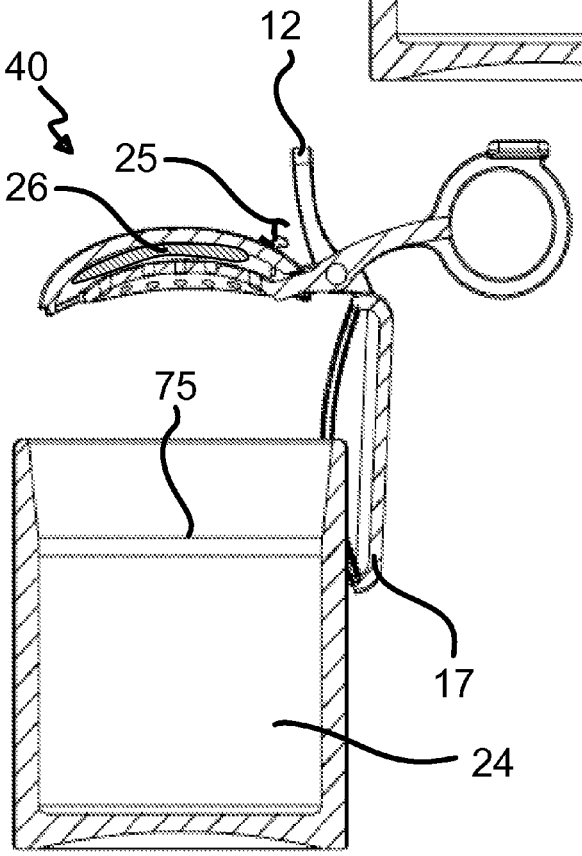
Figure 20:
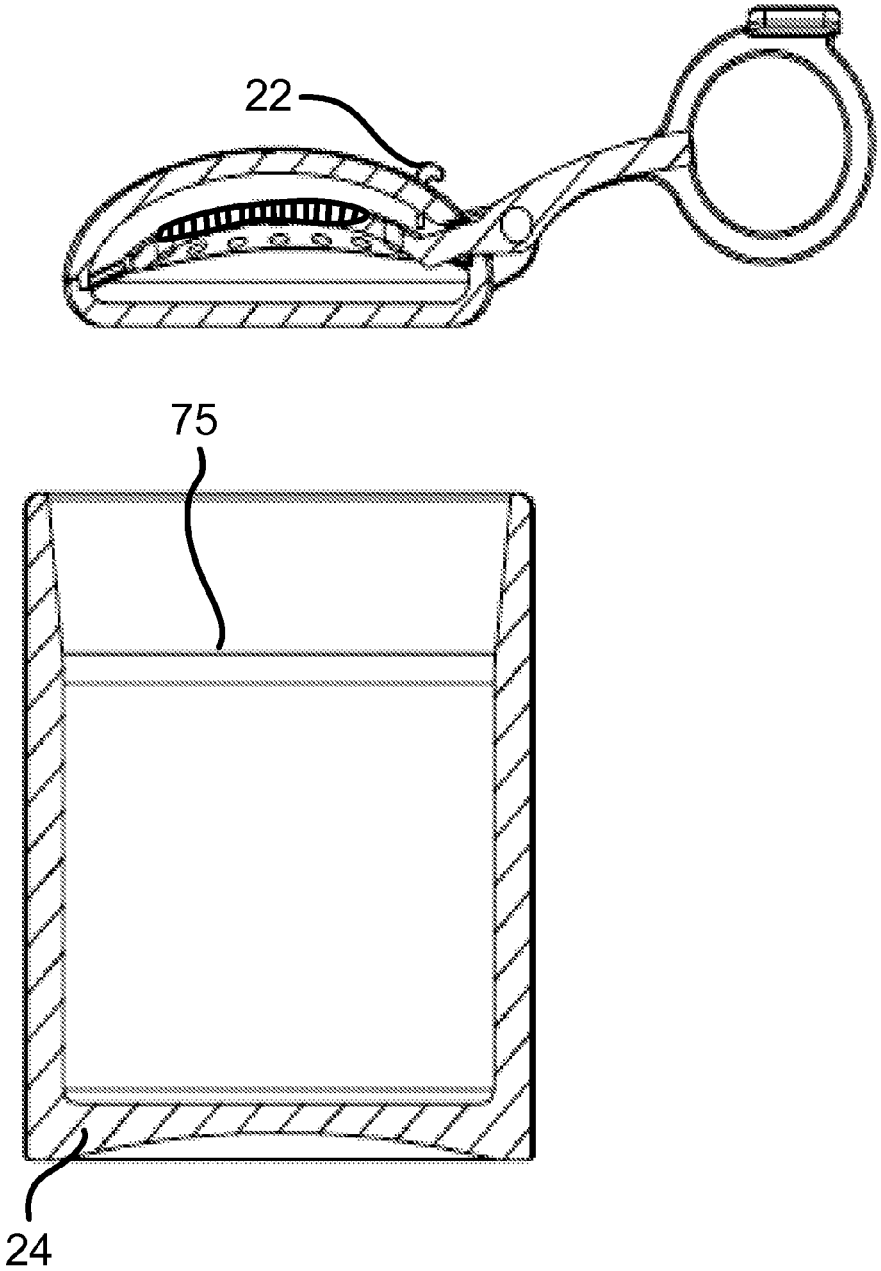

FIGS. 16-20 illustrate the steps for preparing a cup of tea using the tea bag containment device of the present invention. A tea bag 26 is placed in cup 24 filled with hot water to level 75 in a usual manner as shown in FIG. 16. The tea bag containment assembly 40 is placed inside the cup 24 such that the tea bag 26 is disposed between the split plate 11 and porous plate 14 as shown in FIG. 17 while dipping in water. The tea bag string 25 is threaded through slit 47 and onto the anvil 22. This prevents unintended movement of the tea bag. The porous plate 14 is pivoted upward by pushing on handle 15 downward thereby pushing the tea bag 26 against the split plate 11 that is maintained in a stationary position rested against the rim of the cup 24. The tea bag containment device 40 is then lifted straight above the cup 24 in such a manner that the drips from the tea bag 26 fall back into the cup 24 through the holes in the porous plate 14 as depicted in FIG. 18. When the catch plate 17 clears the top of the cup 24, the catch plate 17 is pivoted upward by pushing on tabbed handle 12 downward. This brings the catch plate 17 under the porous plate 14 to close the containment assembly 40 and prevent any additional dripping from falling outside the device 40. The rim 23 around the catch plate 17 insures that the dripping are contained within the catch basin member 10.

Porous plate 14 may be upwardly concave to allow sufficient space to accommodate the tea bag. A range of pore sizes for the plate fall within the scope of the present invention. The plate and the may be made of a low or high mesh material and constructed from but not limited to metal, plastic, wood or a combination thereof. Likewise, the tea bag containment device may be constructed from any suitable material including but not limited to metal, plastic, wood or a combination thereof.

It is noted that surface areas visible to the user such as the top of the split plate and inside the catch plate may be used for logos, inscriptions and ornamental designs.

The tea bag 26 may be reused by placing the closed assembly 40 over a fresh cup of water, releasing the catch plate 17 by pivoting it downward to a vertical position, placing the assembly 40 in position in the cup and repeating the steps described above.

A second embodiment of the present invention relates to a device for containing and handling tea leaves commonly used in preparing a cup of tea. The device is configured to control the flavor transferred to hot water in a quick an efficient manner while preventing potentially messy and scalding liquid drippings from contacting the skin or the outside of the tea cup.

Figure 21:
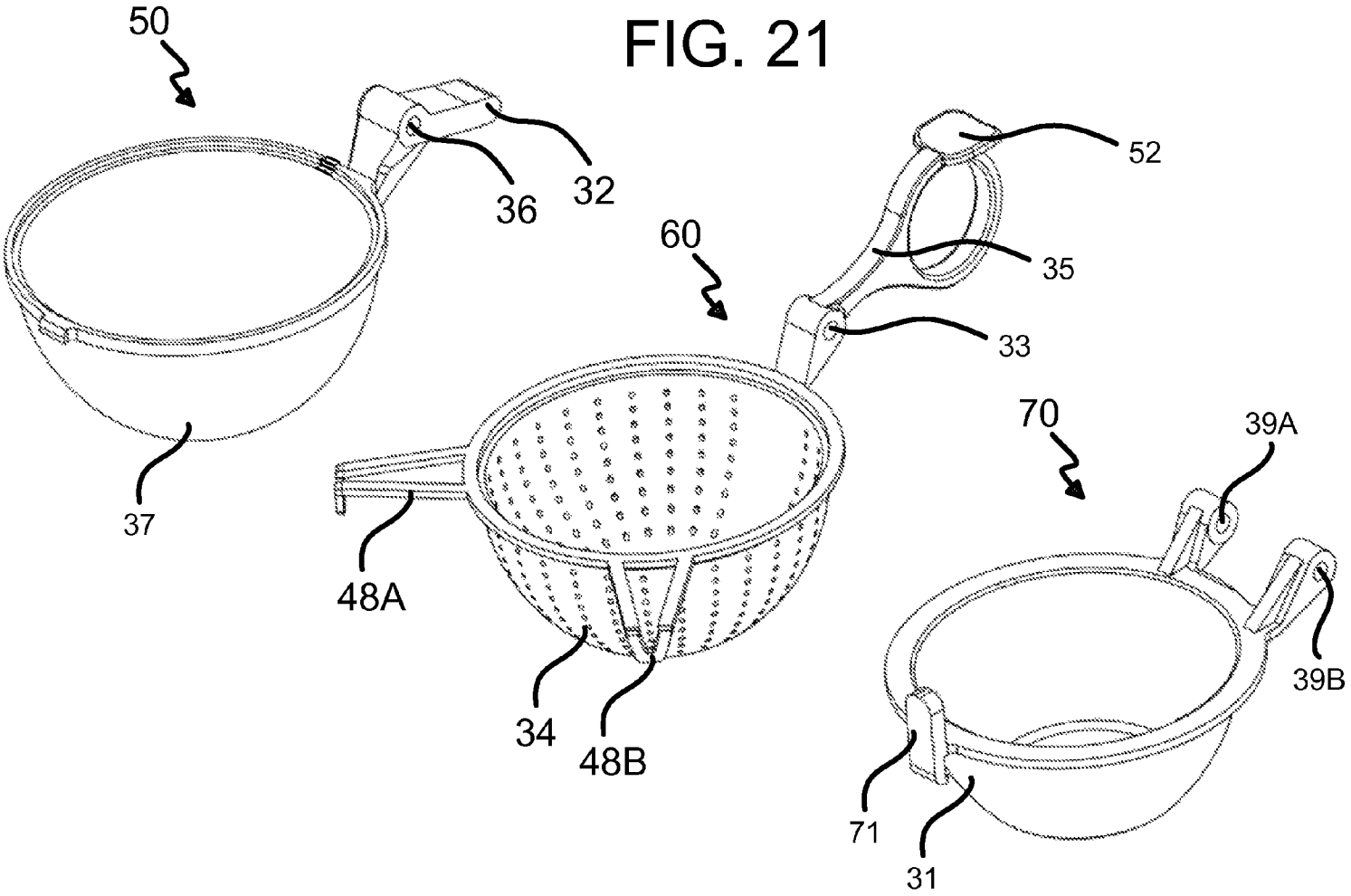
FIG. 21 is an exploded view of the main components of a tea bag containment device according to a second embodiment of the present invention.
Figures 22, 23:
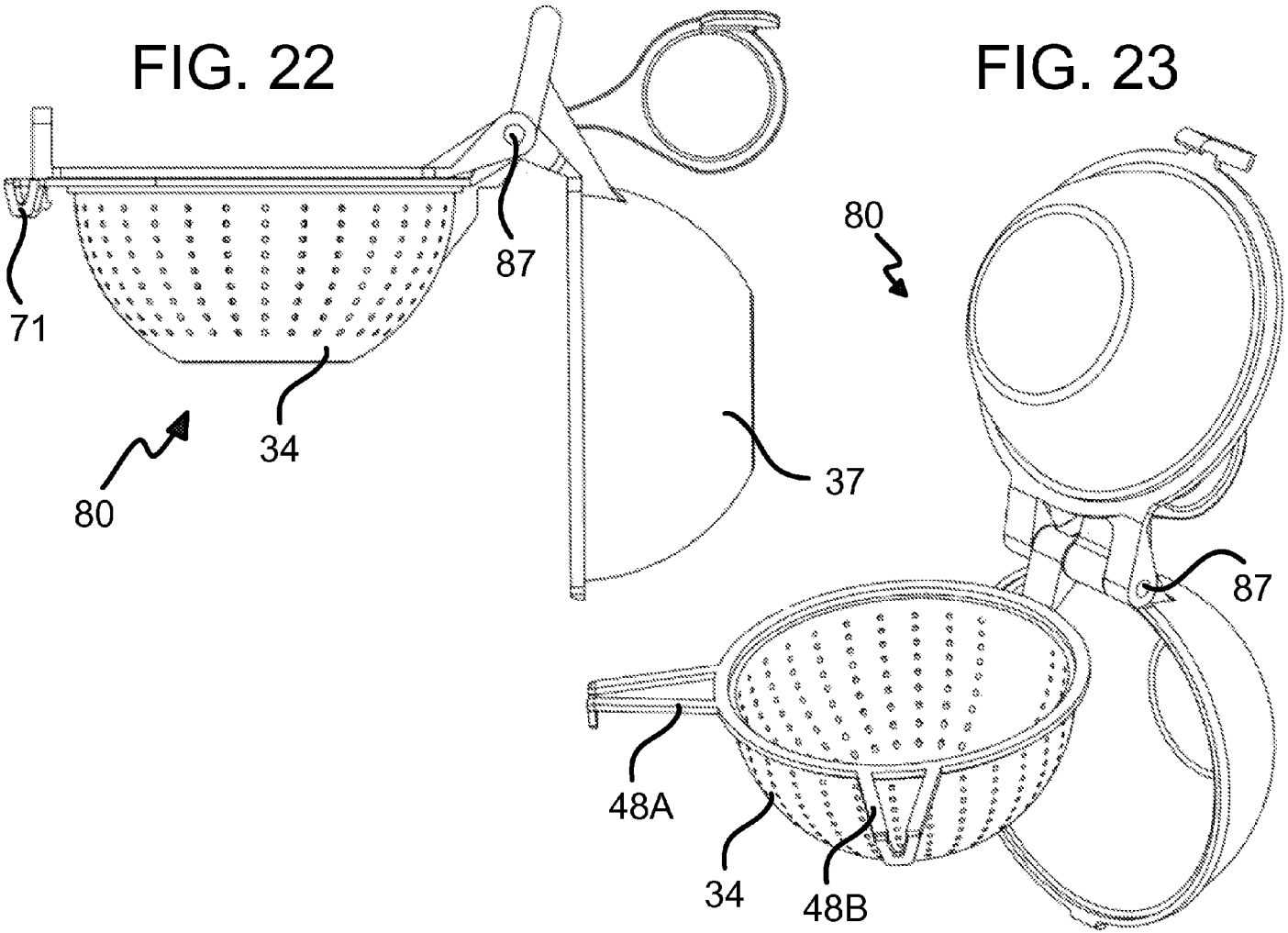
FIGS. 23, 24, and 27 are perspective views of the assembled tea bag containment device shown in different configurations according to the second embodiment of the present invention.
FIGS. 22 and 25 are side views of the assembled tea bag containment device shown in different configurations according to the second embodiment of the present invention.
Figures 24, 25:
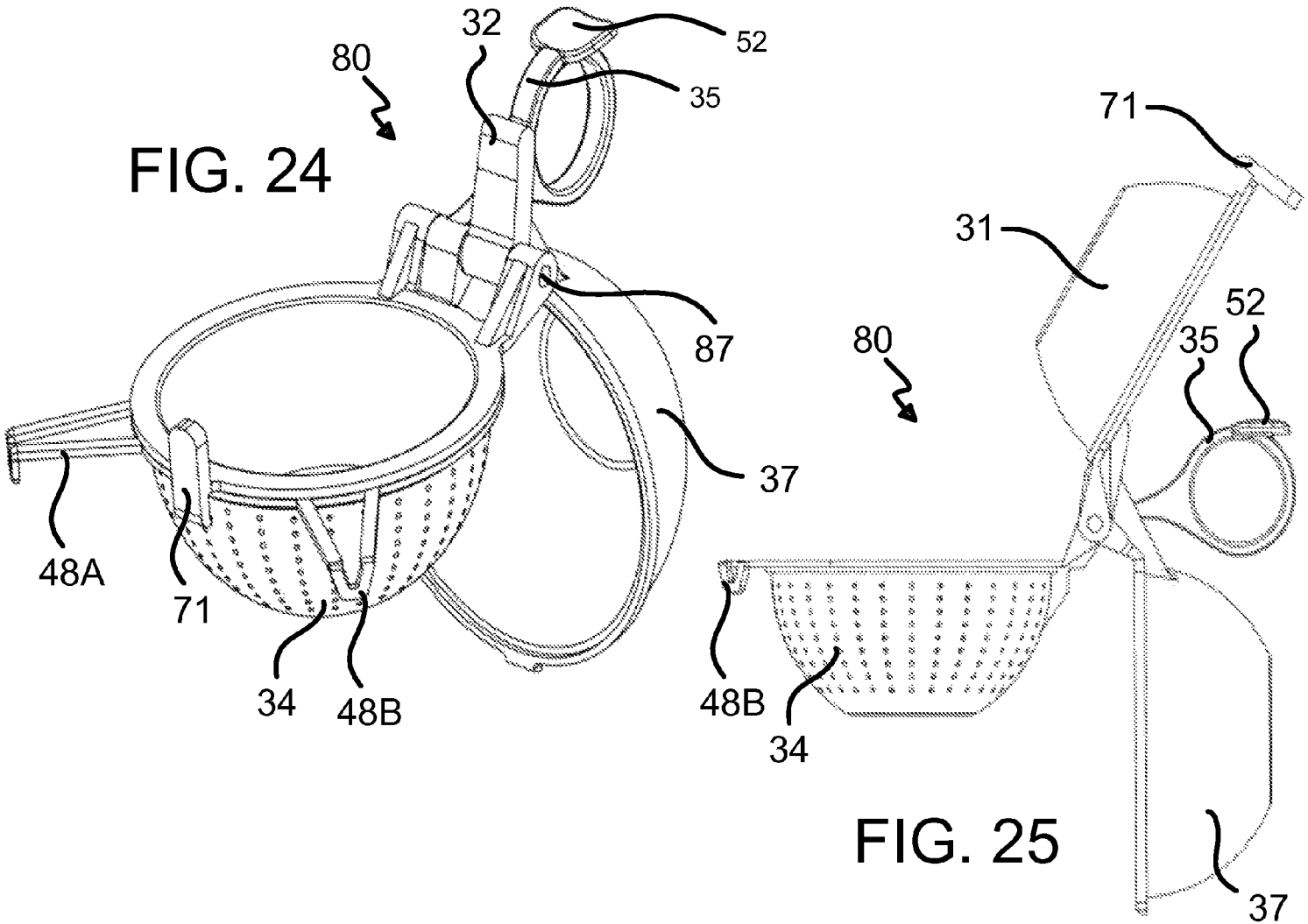

FIGS. 21-38 show the tea leaf containment assembly 80 which represents the second embodiment of the present invention. FIG. 21 shows the main components of the assembly. An upper bowl member 70 contains an upper bowl 31 that is downwardly concave. The upper bowl member 70 also contains pivot axes 39A and 39B and latch 71. A strainer member 60 contains a downwardly concave strainer bowl 34 having a plurality of holes. The strainer member 60 also contains a pivot axis 33 and a handle 35. A catch basin member 50 contains a downwardly concave lower bowl 37, a pivot axis 36 and a handle 32. The strainer bowl 34 contains two lip extensions 48A and 48B. The strainer bowl 34 also has a thumb rest 52 located on the strainer handle 35. The assembled tea leaf containment device 80 is shown in FIGS. 22-29 and 31.

A range of pore sizes for the strainer bowl fall within the scope of the present invention. The strainer bowl may be made of a low or high mesh material and constructed from but not limited to metal, plastic, wood or a combination thereof. Likewise, the tea leaf containment device 80 may be constructed from any suitable material including but not limited to metal, plastic, wood or a combination thereof.

Combining the upper bowl member 70 with the strainer member 60 and the catch basin member 50 is accomplished through the pivot axes 33, 36, 39A and 39B and hinge pin 87. The combined device 80 places the upper bowl 31 over the strainer bowl 34 and the lower bowl 37 below the strainer bowl 34. The combined device 80 is configured to permit the pivoting of the upper bowl 31 from a horizontal position to a vertical position above the strainer bowl 34 and back to a horizontal position. The lower bowl 37 may be pivoted from a horizontal position downward to a vertical position and back to a horizontal position. The pivoting of the upper bowl 31 and lower bowl 37 may be done independently of each other. The strainer bowl 34, while adapted for pivoting, is generally configured to stay in a horizontal position.

Figure 27:
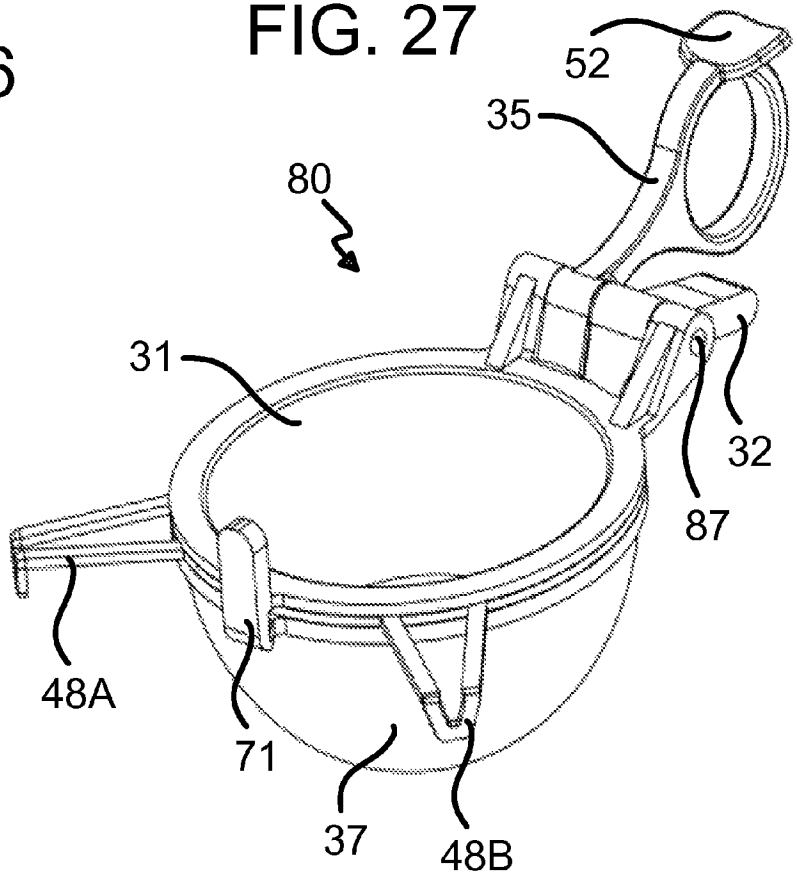
Figure 26:
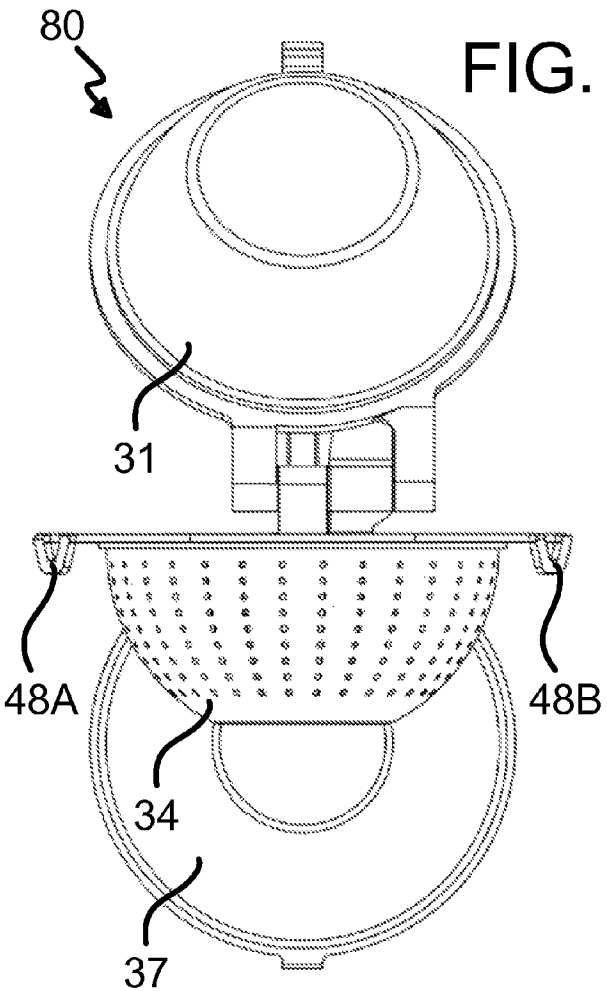
FIGS. 26 and 31 are front views of the assembled tea bag containment device shown in different configurations according to the second embodiment of the present invention.
Figure 29:
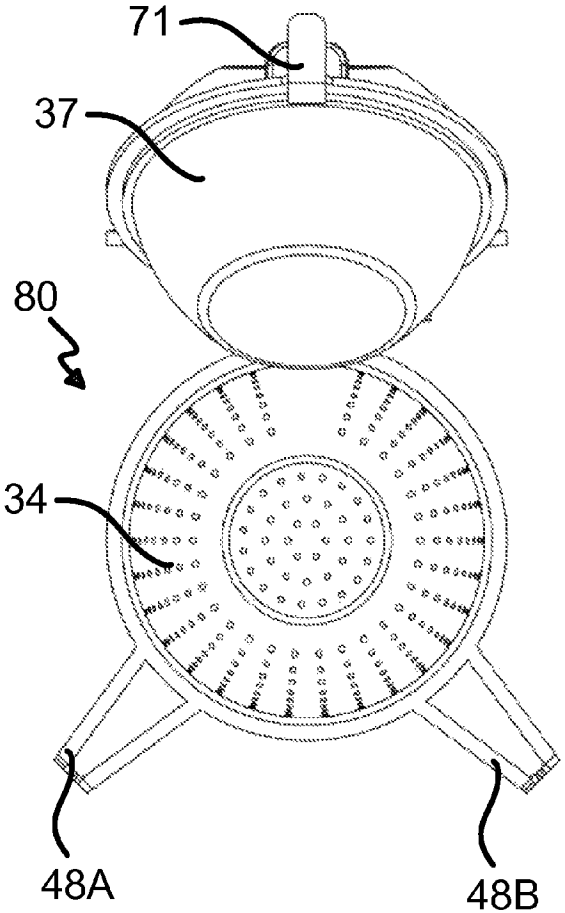
FIGS. 28 and 29 are top views of the assembled tea bag containment device shown in different configurations according to the second embodiment of the present invention.
Figure 28:
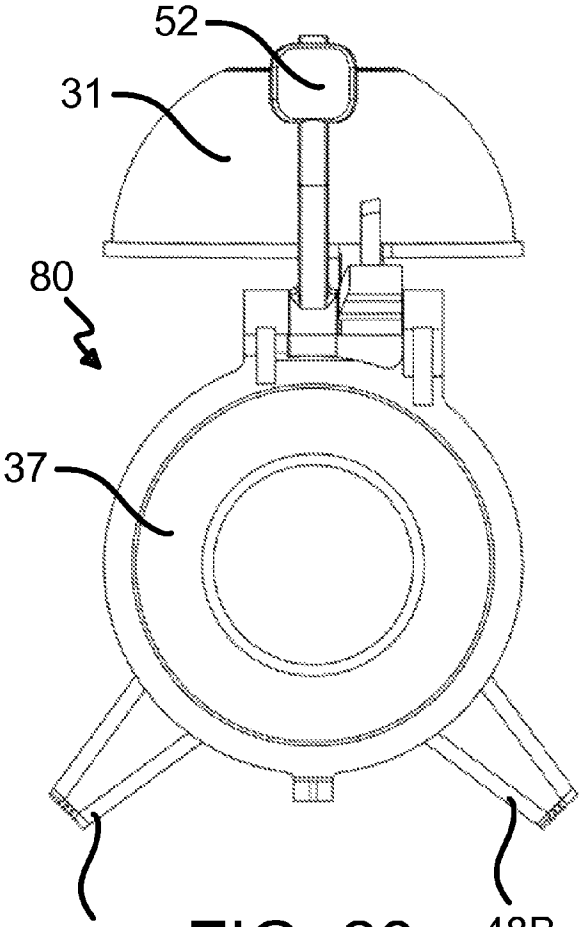
Figures 30, 31:
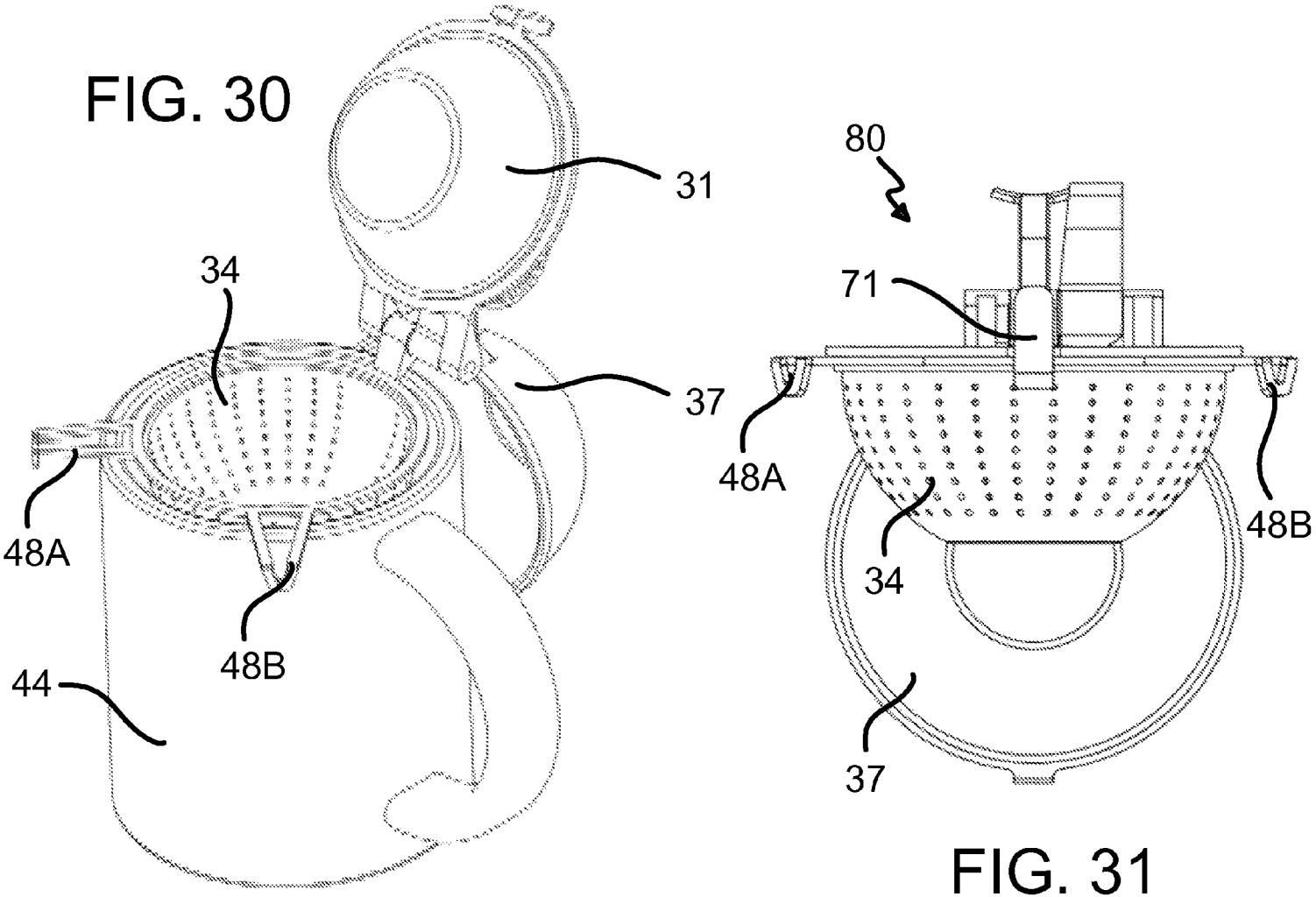
FIGS. 30, 32, 33, 34, 35, 36, 37, and 38 depict the assembled tea bag containment device of the second embodiment of the present invention being used in the course of preparing a cup of tea.
Figure 33:
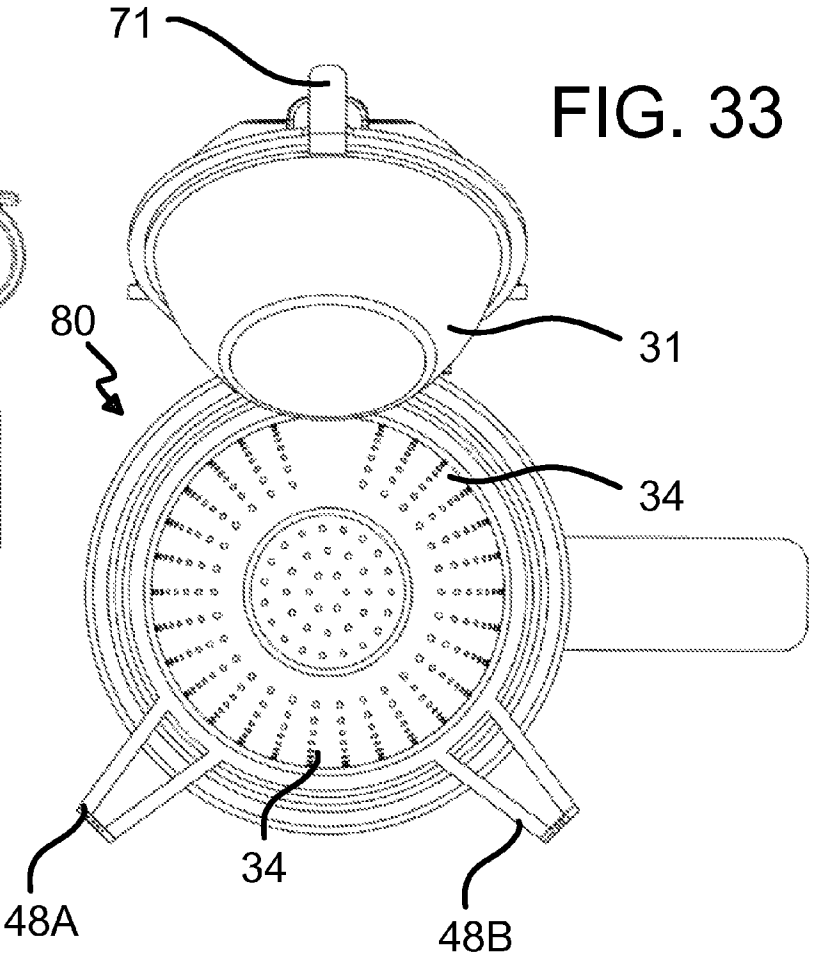
Figure 32:
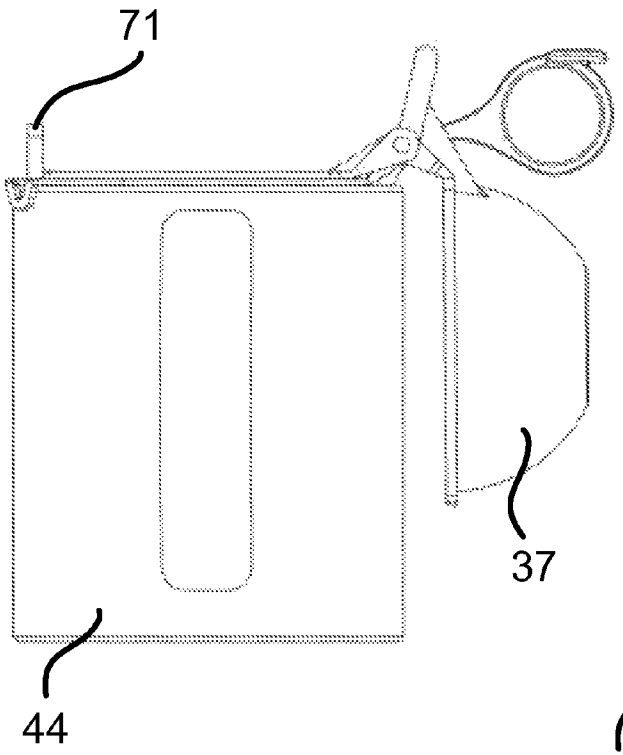
Figure 35:
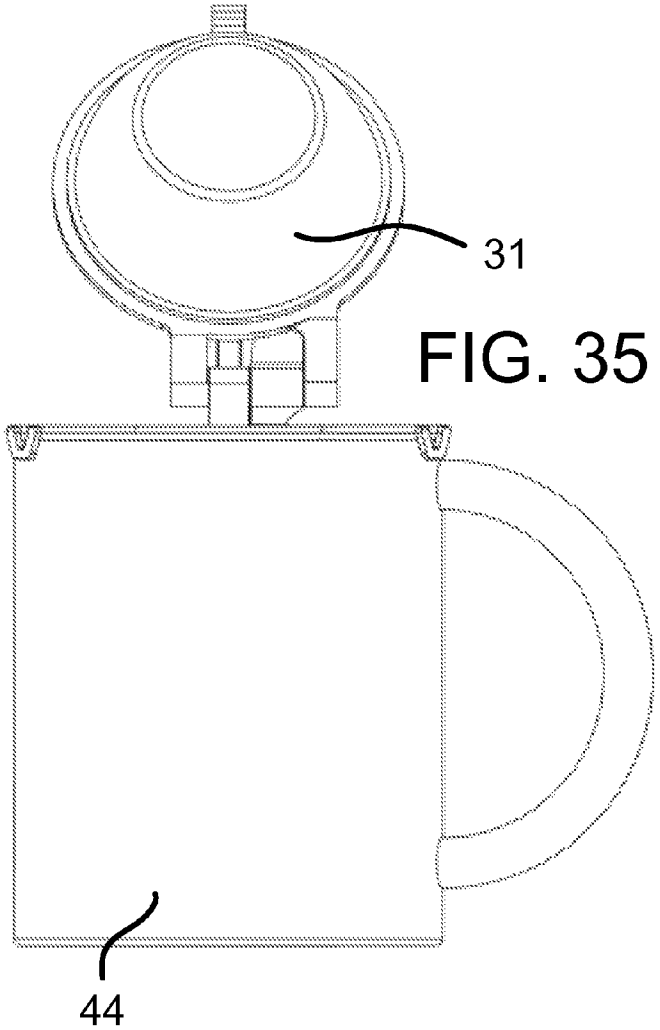
Figure 34:
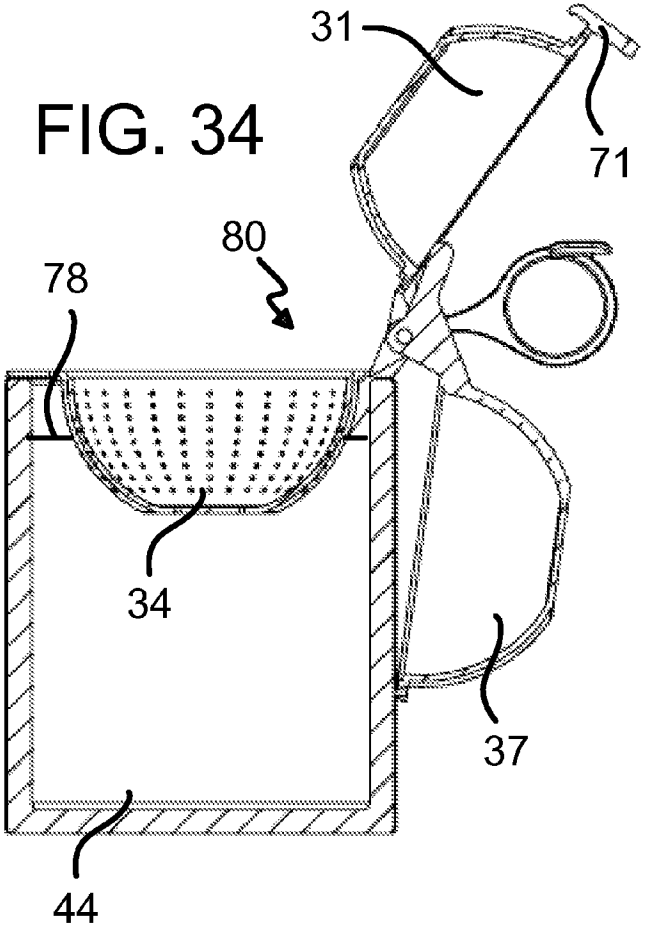

To actuate the pivoting, the tea preparer would press onto or release handles 32 and 35 as appropriate. Thus, in FIGS. 22, 24, 28 and 31 for example, the strainer bowl 34 and the upper bowl 31 are combined in a horizontal position, while the lower bowl 37 is in a vertical position. In FIGS. 23, 25, 26 and 29, the upper bowl 31 and the lower bowl 37 are in a vertical position while the strainer bowl 34 is in a horizontal position. In FIG. 27, the assembly is shown in a closed position wherein all three bowls are in a horizontal position. In the closed position, the components of the device, i.e., the upper bowl member, the strainer member and the catch basin member are constructed to tightly fit over each other using shiplap joinery overlaps in a manner as to prevent leaking of fluid to the outside.

It is noted that any of the inner and outer bowl surface areas visible to the user may be used for logos, inscriptions and ornamental designs.

FIGS. 30 and 32-35 show the positioning of the tea leaf containment assembly 80 in a cup 44. Lip extensions 48A and 48B that are attached to the strainer bowl 34 rest on the rim of the cup 44.

Figure 37:
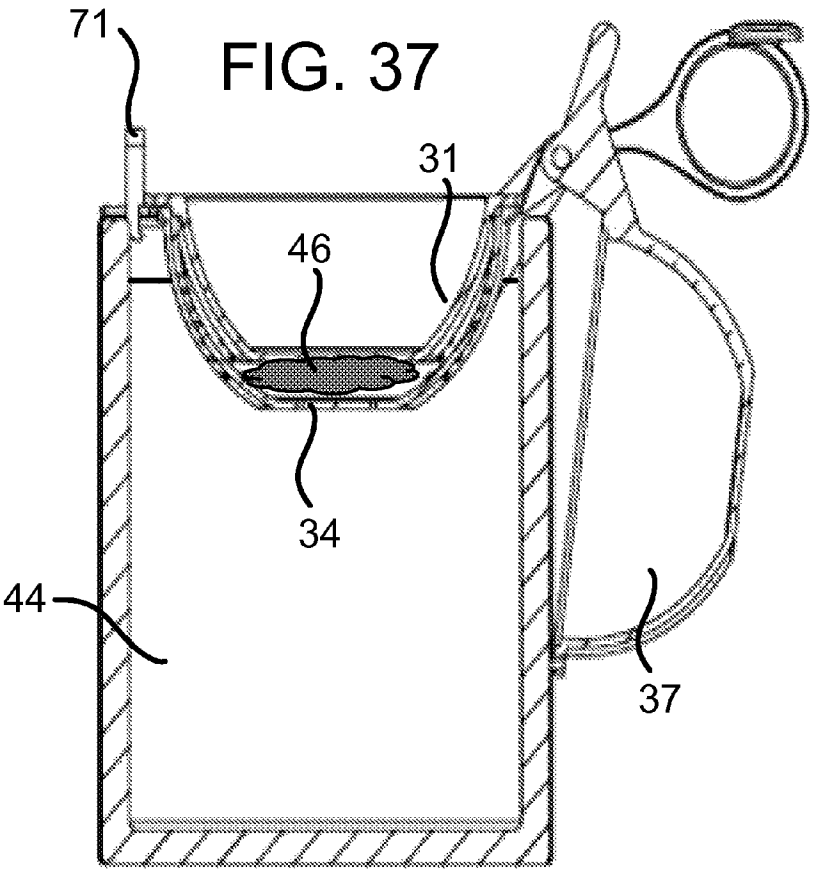
Figure 36:
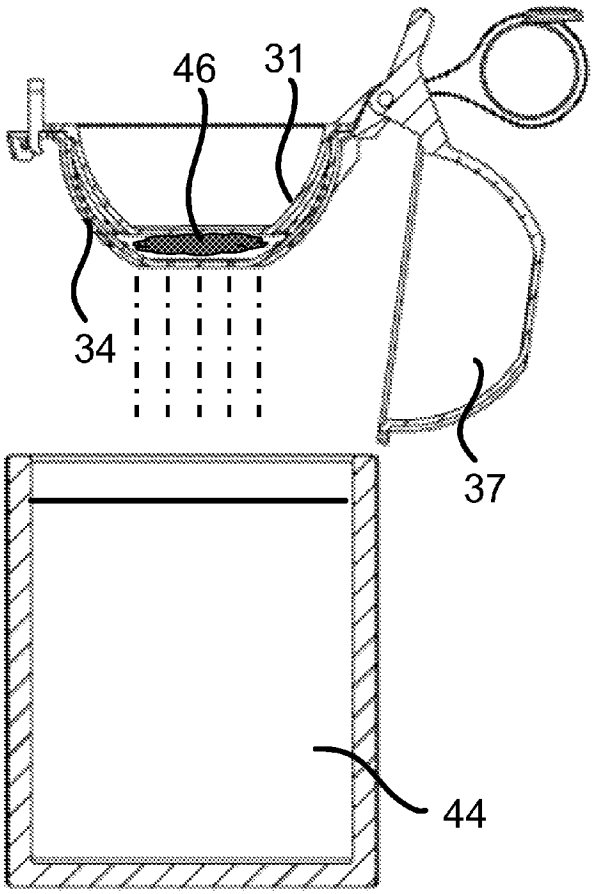
Figure 38:
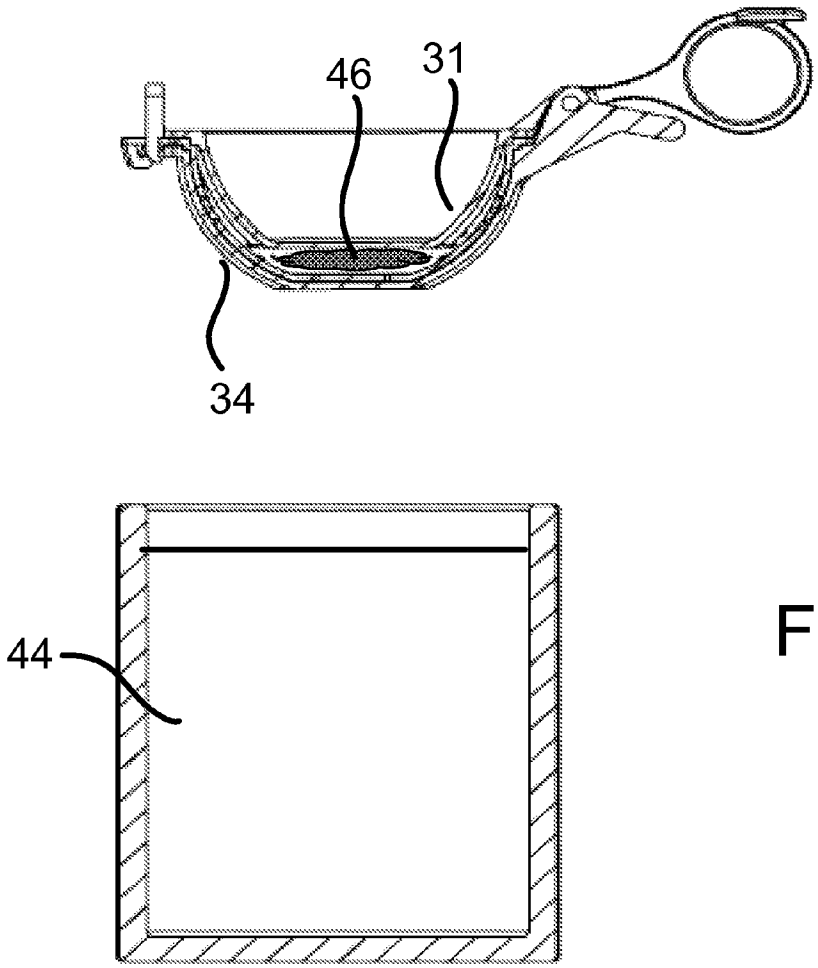

FIGS. 34 and 36-38 illustrate the use of the tea leaf containment assembly 80 for preparing a cup of tea. The assembly 80 is placed inside the cup 44 filled with hot water to a level 78 in a manner shown in FIG. 34. With the upper bowl 31 in a vertical position, the strainer bowl 34 inside the cup and partially immersed in hot water, and the lower bowl 37 in a horizontal position outside the cup 44, tea leaves 46 are introduced inside the strainer bowl 34 such that they are immersed in the hot water that diffused into the strainer bowl 34. After a sufficient time given for the tea leaves 46 to impart their flavor, the upper bowl 31 is lowered over the strainer bowl 34 and latch 71 is locked onto the strainer bowl 34 as shown in FIG. 37. This compresses the tea leaves 46 and further squeezes their flavor into the water. The amount of pressure and exposure time of the leaves to pressure may be used to control the tea flavor. The assembly 80 is then pulled out of the cup 44 straight up as shown in FIG. 36 in a manner that the lower bowl 37 clears the cup and in such a manner that any drippings from the strainer bowl 34 fall back into the cup 44. The lower bowl 37 is then pivoted upward to close the assembly 80 as shown in FIG. 38.

The tea leaves 46 may be reused by placing the closed assembly 80 over a fresh cup of water, releasing the lower bowl 37 by pivoting it downward to a vertical position, placing the assembly 80 in position in the cup and repeating the steps described above.

It is noted that the tea leaf containment device is not limited to tea leaves and may also be used to prepare a cup of tea from a tea bag in a manner similar to that employed with tea leaves.

It should be understood, of course, that the foregoing relates to exemplary embodiments of the invention and that modifications may be made without departing from the spirit and scope of the invention.

The invention claimed is:

1. A tea bag containment assembly for manipulating a hot tea bag in the course of preparing a cup of tea, said device comprising:

an upper plate member containing a split plate having a center slit, a pivot axis and a handle;

an open plate member containing a porous plate having a plurality of holes, a pivot axis and a handle; and a catch basin member containing a closed catch plate having a rim around an upper part of the catch plate, said catch basin member also comprising a pivot axis and a handle, said split plate being configured for placement on top of the porous plate, said porous plate being configured for placement over the catch plate, said porous plate configured for allowing liquid to drain through, said split plate, porous plate and catch plate being configured for pivotal attachment to one another, said attachment being accomplished by means of a hinge pin that threads through the pivot axis of the upper plate member, the pivot axis of the open plate member and the pivot axis of the catch basin member.

2. The device of claim 1, wherein the porous plate is adapted for pivoting from a horizontal position to a vertical position wherein a front side of the porous plate is disposed below the split plate.

3. The device of claim 1, wherein the catch plate is adapted for pivoting from a horizontal position to a vertical position wherein in said vertical position a front side of the catch plate is disposed below the split plate and below the porous plate.

4. The device of claim 1, further comprising one or more lips extending from a top surface of the split plate, said lips being adapted to rest against a top rim of the cup.

5. The device of claim 1, wherein a top surface of the porous plate is adapted to contact and apply pressure onto a bottom surface of the split plate when the porous plate is pivoted upward and the split plate is held in a fixed position.

6. The device of claim 1, further comprising an anvil disposed at a rear end of the split plate center slit to hold the tea bag in proximity to a hinge line of the split plate for subsequent compression.

7. The device of claim 1, further comprising a thumb rest disposed onto the split plate handle.

8. A method for preparing a cup of tea from a tea bag having a string attached to the tea bag in a standard cup having inner and outer walls, said method comprising:

providing a tea bag containment assembly, said tea bag containment assembly comprising an upper plate member containing a split plate having a center slit, a pivot axis and a handle; an open plate member containing a porous plate having a plurality of holes, a pivot axis and a handle; and a catch basin member containing a closed catch plate having a rim around an upper part of the catch plate, said catch basin member also comprising a pivot axis and a handle, said split plate containing an anvil, said anvil being disposed at a rear side of the center slit, said porous plate and catch plate being pivotally attached to the split plate, said split plate also containing at least one lip extending out of a front side of the split plate, said porous plate being configured to exert pressure onto a bottom of the split plate;

providing a cup having a wall and a top rim, said cup containing hot water;

placing an unused tea bag inside the cup, said tea bag string being held in a manner as to prevent the tea bag from falling into the cup and in a manner as to enable preparing a cup of tea;

placing the tea bag containment assembly onto the cup wherein the split plate is disposed onto the rim of said cup, the catch plate is disposed outside the cup alongside an outer side of the cup wall and said porous plate being disposed inside the cup below the tea bag;

pivoting said porous plate upward in a manner as to trap and squeeze the tea bag against the split plate;

moving the tea bag containment assembly upward in such a manner that the catch plate clears the cup, and drippings from the tea bag that go through the porous plate fall into the cup;

pivoting the catch plate upward toward the porous plate in a manner as to contain any further drippings from the tea bag; and enjoying a delicious cup of tea.

9. The method for preparing the cup of tea of claim 8, further comprising threading the tea bag string onto the anvil.

10. The method for preparing a cup of tea of claim 8, further comprising optionally reusing the tea bag, said reusing being accomplished by:

placing over a fresh cup of hot water a closed tea bag containment assembly containing a used tea bag disposed between the split plate and porous plate;

pivoting the catch plate downward to position said catch plate in a vertical position;

placing the split plate and porous plate onto a rim of the cup of fresh hot water wherein the catch plate becomes situated against an outer portion of the cup wall; and pivoting the porous plate downward in a manner as to release the tea bag to float inside the water.

11. A tea leaf containment assembly for making a cup of tea from tea leaves, said device comprising:

an upper bowl member containing an upper bowl, said upper bowl being downwardly concave, said upper bowl member also containing a pivot axis;

a strainer member containing a downwardly concave strainer bowl having a plurality of holes, said strainer member also containing a pivot axis and a handle; and a catch basin member containing a downwardly concave lower bowl, said catch basin member also containing a pivot axis and a handle, said upper bowl being configured for placement on top of the strainer bowl, said strainer bowl being configured for placement over the lower bowl, said strainer bowl being configured for allowing liquid to drain through, said upper bowl, strainer bowl and lower bowl being configured for pivotal attachment to one another, said attachment being accomplished by means of a hinge pin that threads through the pivot axis of the upper bowl member, the pivot axis of the strainer member and the pivot axis of the catch basin member.

12. The device of claim 11, wherein the upper bowl is adapted for pivoting from a horizontal position to a vertical position wherein, in said vertical position, a front side of the upper bowl is disposed above the strainer bowl.

13. The device of claim 11, wherein the lower bowl is configured for pivoting from a horizontal position to a vertical position wherein, in said vertical position, a front side of the lower bowl is disposed below the strainer bowl.

14. The device of claim 11, further comprising one or more lips extending from a top surface of the strainer bowl, said lips being adapted to rest against a top rim of the cup.

15. The device of claim 11, wherein a bottom surface of the upper bowl is adapted to contact and apply pressure onto an inside surface of the strainer when the upper bowl is disposed onto the strainer bowl.

16. The device of claim 11 further comprising a latch disposed onto the front side of the upper bowl, said latch being configured to lock the upper bowl onto the strainer bowl in a manner as to lock and maintain pressure of the upper bowl onto the strainer bowl.

17. The device of claim 1, further comprising a thumb rest disposed onto the strainer member handle.

18. A method for preparing a cup of tea from tea leaves in a standard cup having inner and outer walls, said method comprising:

providing a tea leaf containment assembly, said tea leaf containment assembly comprising an upper bowl member containing an upper bowl, said upper bowl being downwardly concave, said upper bowl member also containing a pivot axis; a strainer member containing a downwardly concave strainer bowl having a plurality of holes, said strainer member also containing a pivot axis and a handle; and a catch basin member containing a downwardly concave lower bowl, said catch basin member also containing a pivot axis and a handle, said strainer bowl and lower bowl being pivotally attached to the upper bowl, said strainer bowl also containing at least one lip extending out of a front side of the strainer bowl, said upper bowl being configured to exert pressure onto the strainer bowl;

providing a cup having a wall and a top rim, said cup containing hot water;

placing a tea leaf containment assembly onto the cup wherein the strainer bowl is placed over the cup rim in such a manner that the extending lips rest against the rim, the upper bowl is elevated above the strainer bowl and the lower bowl is pivoted downward and disposed outside the cup alongside an outer side of the cup wall, wherein a lower portion of the strainer bowl is immersed in the water;

placing tea leaves inside the strainer bowl;

pivoting said upper bowl downward onto the strainer bowl in a manner as to trap and squeeze the tea leaves against the strainer;

moving the tea containment assembly upward in such a manner that the lower bowl clears the cup and in a manner that tea drippings from the tea leaves that pass through the strainer bowl fall into the cup;

pivoting the lower bowl upward toward the strainer bowl to align horizontally with the strainer bowl in a manner as to contain any further drippings from the tea leaves; and enjoying a delicious cup of tea.

19. The method of claim 18 further comprising locking the upper bowl onto the strainer, said locking being accomplished by the latch disposed at a front side of the strainer.

20. The method of claim 18 further comprising optionally reusing the tea leaves, said reusing the tea leaves being accomplished by:

placing a closed tea leaf containment assembly containing used tea leaves disposed between the upper bowl and strainer bowl over a fresh cup of hot water;

pivoting the lower bowl downward to position said lower bowl in a vertical position; and placing the upper bowl and strainer bowl into the water and the lower bowl alongside an outer wall of the cup.

* * * * *